US009099259B2

(12) United States Patent
Bunk et al.

(10) Patent No.: US 9,099,259 B2
(45) Date of Patent: Aug. 4, 2015

(54) LATCH FOR A CIRCUIT BREAKER

(71) Applicants: Thomas Bunk, Sulzbach-Rosenberg (DE); Siegfried Pirker, Ensdorf (DE)

(72) Inventors: Thomas Bunk, Sulzbach-Rosenberg (DE); Siegfried Pirker, Ensdorf (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 187 days.

(21) Appl. No.: 13/748,884

(22) Filed: Jan. 24, 2013

(65) Prior Publication Data

US 2013/0228430 A1 Sep. 5, 2013

(30) Foreign Application Priority Data

Mar. 2, 2012 (DE) ..... 10 2012 203 295

(51) Int. Cl.
*H01H 71/50* (2006.01)
*H01H 71/52* (2006.01)
*H01H 3/30* (2006.01)

(52) U.S. Cl.
CPC ..... *H01H 3/3031* (2013.01); *H01H 71/505* (2013.01); *H01H 71/525* (2013.01); *H01H 2071/506* (2013.01)

(58) Field of Classification Search
CPC ..... H01H 71/50; H01H 71/52
USPC ..... 335/172, 167, 21
See application file for complete search history.

(56) References Cited

U.S. PATENT DOCUMENTS

| | | | | |
|---|---|---|---|---|
| 1,807,041 A | | 5/1931 | Lingal | |
| 5,300,907 A | * | 4/1994 | Nereau et al. | 335/172 |
| 5,534,835 A | * | 7/1996 | McColloch et al. | 335/172 |

FOREIGN PATENT DOCUMENTS

| | | | |
|---|---|---|---|
| DE | 1221339 | B | 7/1966 |
| DE | 1989915 | U | 7/1968 |
| DE | 3002795 | A1 | 7/1981 |
| DE | 102005050693 | A1 | 4/2007 |
| DE | 102009007478 | A1 | 8/2010 |

* cited by examiner

*Primary Examiner* — Renee Luebke
*Assistant Examiner* — Ahmed Saeed
(74) *Attorney, Agent, or Firm* — Harness, Dickey & Pierce, P.L.C.

(57) ABSTRACT

A circuit breaker includes a latch including a switching mechanism for opening and closing a switching contact operatively connected to a tensioning element, and an unlatching mechanism by which, on the basis of a tripping signal, the tensioning element can be changed from a tensioned to an at least largely untensioned state, thereby opening the switching contact. In an embodiment, the tensioning element is indirectly linked to a tensioning lever having a locating surface on which a locking pawl of the unlatching mechanism bears in the tensioned state of the tensioning element. The locating surface is curved in the direction of the locking pawl and is movably disposed relative to the tensioning lever.

14 Claims, 7 Drawing Sheets

$F_N$
K
$h_{pawl}$
8
12
13
7
16
5

$F_{N\ var.}$
var.
K
$h_{pawl}$
8
12
13
5

$F_{N\ var.}$
var.
K
$h_{pawl}$
8
12
13
5

LATCH FOR A CIRCUIT BREAKER

PRIORITY STATEMENT

The present application hereby claims priority under 35 U.S.C. §119 to German patent application number DE 10 2012 203 295.9 filed Mar. 2, 2012, the entire contents of which are hereby incorporated herein by reference.

FIELD

At least one embodiment of the invention generally relates to a circuit breaker including a latch. A generic latch includes a switching device for opening and closing a switching contact operatively connected to a tensioning element, and an unlatching mechanism by which, on the basis of a tripping signal, the tensioning element can be changed from a tensioned state to an at least largely untensioned state.

BACKGROUND

Circuit breakers are special switches that are usually designed for high currents. These devices can not only switch operating currents and small overload currents, but also, in the event of faults, establish high overload currents and short circuit currents, maintain these fault currents for a specified time and interrupt them again. Circuit breakers are single-pole or multipole type depending on design.

Such circuit breakers generally incorporate so-called latches which, in the event of unwanted operating states, particularly short circuits, cause the circuit to be interrupted.

A latch is a mechanical device which preferably enables a circuit to be interrupted. For this purpose, to open the switching contacts, the force of a charged spring that has been charged via a tensioning mechanism on closure is usually released. The typical tripping criterion is a current of a predefinable magnitude whereby the locking is released by way of a solenoid or a bimetallic strip which becomes heated.

The latch of a circuit breaker has two essential regions. On the one hand, a switching mechanism is provided via which the opening and closing of an electrical switching contact is implemented subject to the spring force applied. On the other hand, such a latch has an unlatching mechanism which, when a tripping criterion is achieved, releases the energy stored in a spring of the switching mechanism, thereby tripping the latch and opening the electrical switching contact.

The problem with the latches known from the prior art is often that, in the locked state, the locking pawl provided inside the unlatching mechanism is brought into contact with a flat surface of the outer contour of the tensioning lever operatively connected to the spring. Since during operation of the circuit breaker the locking pawl thus comes into contact again and again with the same area of the locating surface of the tensioning lever, signs of wear become apparent the longer the breaker is in service. As a result of this abrasion of the locating surface, the direction of the normal force changes and therefore also the torque induced in the locating surface of the tensioning lever via the locking pawl. A higher torque in this area in turn causes the force required for tripping the latch to be increased.

Although it is possible to reduce the wear by employing harder materials or using a surface treatment process, this would increase the production costs of a corresponding component. Another possibility for reducing the locating surface abrasion is to implement a full surface lining between locking pawl and locating surface of the tensioning lever. The disadvantage of this, however, is that the lever arm of the normal force, i.e. the distance between the normal force vector and the force-inducing region of the locking pawl, can vary, which would result in fluctuations in the force required to trip the latch.

SUMMARY

At least one embodiment of the invention is dorected to an unlatching mechanism of a latch such that the force of the switching mechanism is minimized by as large a factor as possible within a limited available space. The unlatching mechanism to be specified is characterized by high starting reliability which shall be ensured primarily by low friction inside the unlatching mechanism. Critical for high starting reliability is, on the one hand, that the tripping force is not excessively large and, on the other, that the tripping force remains approximately constant even after a lengthy period of service. In particular, it shall be ensured that tripping of the latch is possible irrespective of the force in the switching mechanism. In addition, the unlatching mechanism shall be embodied such that the latch can be used both for single-pole switches, wherein only low forces occur in the switching mechanism, and also for multi-pole switches having high forces in the switching mechanism.

Advantageous embodiments of the invention are the subject matter of the dependent claims and will be explained in greater detail in the following description with reference to the figures in some cases.

A circuit breaker of an embodiment includes a latch which has, on the one hand, a switching device for opening and closing a switching contact operatively connected to a tensioning element and, on the other, an unlatching mechanism by which, on the basis of a tripping signal, the tensioning element can be changed from a tensioned state to an at least largely untensioned state, thereby opening the switching contact. The tensioning element is linked to a tensioning lever which is locked by a locking pawl of the unlatching mechanism bearing on a locating surface of the tensioning lever and preventing the latter from moving, so that the spring element is maintained in the tensioned state. The latch is inventively developed such that the locating surface is convex and is movably disposed relative to the tensioning lever.

BRIEF DESCRIPTION OF THE DRAWINGS

Without limiting the general inventive concept, the invention will now be explained in greater detail with reference to example embodiments and the accompanying drawings in which.

DETAILED DESCRIPTION OF THE EXAMPLE EMBODIMENTS

Figure 1:
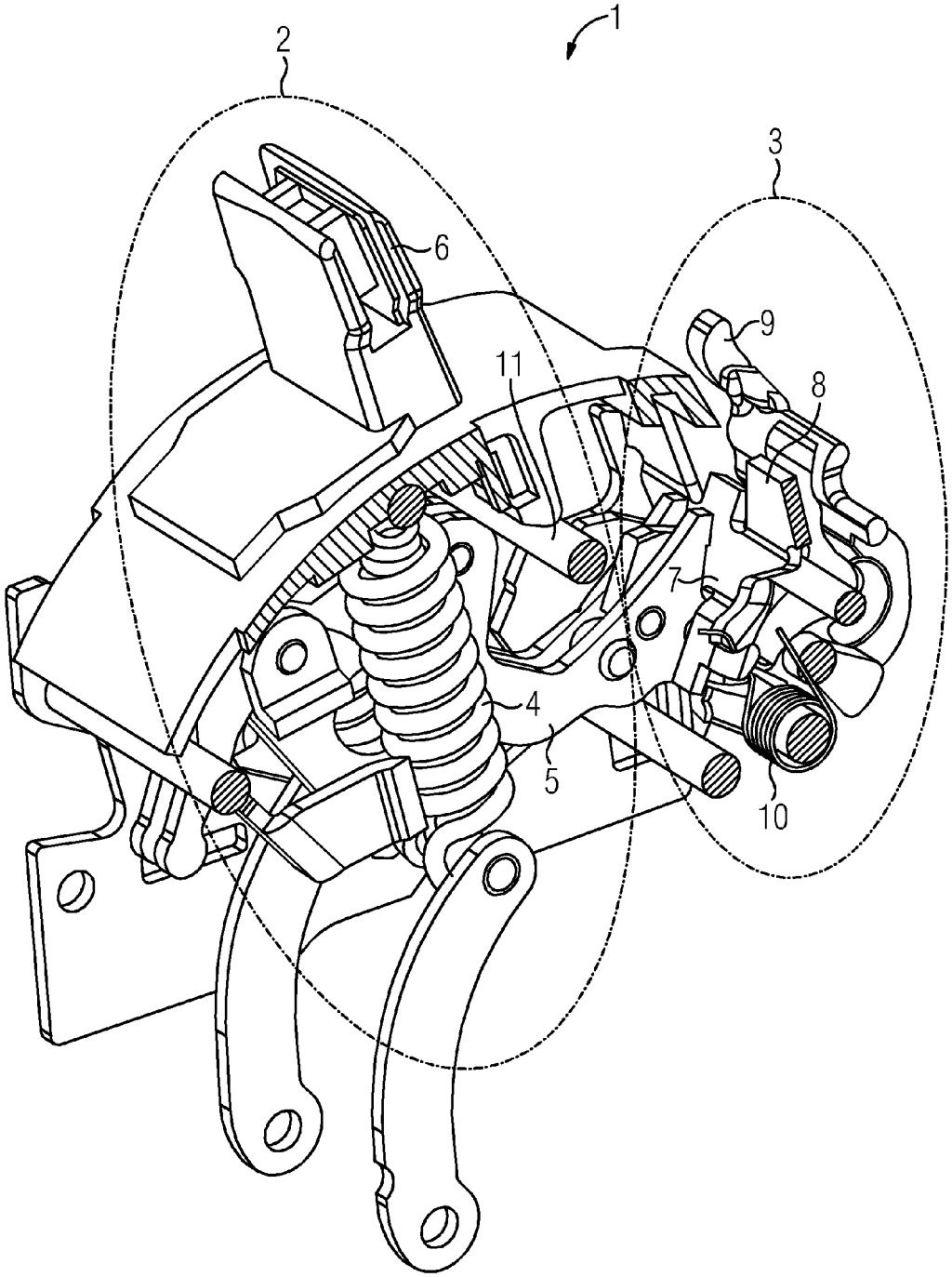
FIG. 1 shows a perspective view of the latch of a circuit breaker.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

An advantage of the locating surface having a convex external contour in the direction of the locking pawl, while at the same time being movably mounted, is that there is no flat contact surface between the locking pawl and the tensioning lever, and the locking pawl moves across the locating surface in a comparatively frictionless manner when the latch is tripped, thus minimizing wear. In particular, this ensures that the locking pawl can be brought into contact with different regions of the locating surface and there is mainly only rolling friction between locking pawl and locating surface.

In a specific embodiment of the invention, the external circumferential surface of a roller constitutes the locating surface. The roller is preferably rotatably mounted on the tensioning lever. In the locked state of the latch, the end of the locking pawl is in contact with the locating surface, i.e. the external circumferential surface of the roller. As soon as the latch trips, the locking pawl is moved such that the force induced in the roller of the tensioning lever via the pawl decreases so that finally the tensioning lever is set in motion and the end of the locking pawl rolls across the external circumferential surface of the roller. The resulting friction is minimal.

The above described roller of an unlatching mechanism can preferably be mounted in two different ways. In a first specific development of an embodiment of the invention, the tensioning lever is of one-piece design and the roller is rotatably mounted in a suitable recess using a bearing pin. In an alternative arrangement, the tensioning lever is of multi-part design, wherein in particular two suitably contoured metal plates disposed in a plane-parallel manner are provided, and the roller is rotatably mounted between these plates about a bearing pin.

According to another specific embodiment of the invention, it is possible for the locating surface and/or the free end of the locking pawl to be provided with a surface coating. Such a coating preferably has high wear resistance or ensures that the friction between the end of the locking pawl and the locating surface is at least minimized. If a roller whose external circumferential surface constitutes the locating surface is provided, this can be embodied as a metal or plastic roller (ceramics, etc.). The roller is preferably manufactured as a turned part.

The inventively designed latch of an embodiment is therefore characterized primarily in that a locating surface that is convex in the direction of the free end of the locking pawl and is movably disposed relative to the tensioning lever is provided in the unlatching mechanism. In the locked state of the latch, a roller whose external circumferential surface constitutes the locating surface is preferably brought into engagement with the end of the locking pawl. Here, the inventive solution of an embodiment is characterized in that, in spite of comparatively small overall dimensions, the tripping force required for tripping the latch is minimized. An embodiment of the inventively designed latch can therefore be used in the same way both for single- and three- or four-pole switches. This is mainly due to the fact that the operation of the unlatching mechanism is at least largely independent of the force in the switching mechanism.

The movable locating surface on the tensioning lever, preferably a roller, ensures that the friction produced when the locking pawl slides off the tensioning lever is reduced compared to the known solutions. Put simply it can be assumed in this case that the effect of friction is reduced by a factor R/r, where R represents the outside radius of the roller and r the roller bearing radius. If, for example, a roller having an outside radius of 5.4 cm and a roller bearing radius of 1.7 cm is used, this produces a factor of 3.8, i.e. a significant reduction in the frictional resistance. By greatly minimizing the effect of friction in this way, on the one hand the starting reliability of the latch is increased and, on the other, the leverages in the unlatching mechanism can be adjusted such that the reduction of the force from the switching mechanism to the tripping shaft of the unlatching mechanism is very large and therefore only a very small force is required to trip the latch.

FIG. 1 shows a perspective view of the latch 1 of a circuit breaker. The latch 1 shown here comprises two main assemblies, namely the switching mechanism 2 on the one hand, and the unlatching mechanism 3 on the other. The electrical switching contact of the circuit breaker is operatively connected via the switching mechanism 2 to a spring 4 used as an energy store such that, when the contact is closed, the spring 4 is charged and, when the latch 1 is tripped, the energy stored in the spring 4 is released, so that the contact is opened by the spring force exerted thereon.

In order, on the one hand, to enable the spring 4 to be reliably maintained in the charged state and, on the other hand, to be able to ensure reliable and rapid tripping of the latch, the unlatching mechanism 3 is provided.

The connection between the switching mechanism 2 with tensioning spring 4 and the unlatching mechanism 3 is established via a tensioning lever 5 which can be locked or released by the unlatching mechanism 3 as required. As soon as the tensioning lever 5 is released by the unlatching mechanism 3, the spring 4 relaxes and the electrical switching contact is opened.

An essential component of the unlatching mechanism 3 is the pawl spring 10 which acts on the locking pawl 8 such that the end of the locking pawl 8 is moved against a suitably provided locating surface of the tensioning lever 5 in order to lock the tensioning lever 5. Additionally provided in the unlatching mechanism 3 is a tripping shaft 9 which, when a tripping criterion is attained, in particular as soon as the current in the switch reaches a predefined magnitude, is caused to rotate or rather pivot. The motion of the tripping shaft 9 causes it to make contact with the locking pawl 8 such that the locking pawl 8 is also pivoted, thus reducing the force exerted by the end of the locking pawl 8 on the locating surface of the tensioning lever 5. The reduction in the force exerted by the locking pawl 8 on the locating surface of the tensioning lever 5 also causes the locking of the tensioning lever 5 to be released, the spring 4 to relax and the switching contact to be opened.

The different switching states of the latch 1 will now be explained in detail.

Figure 3:
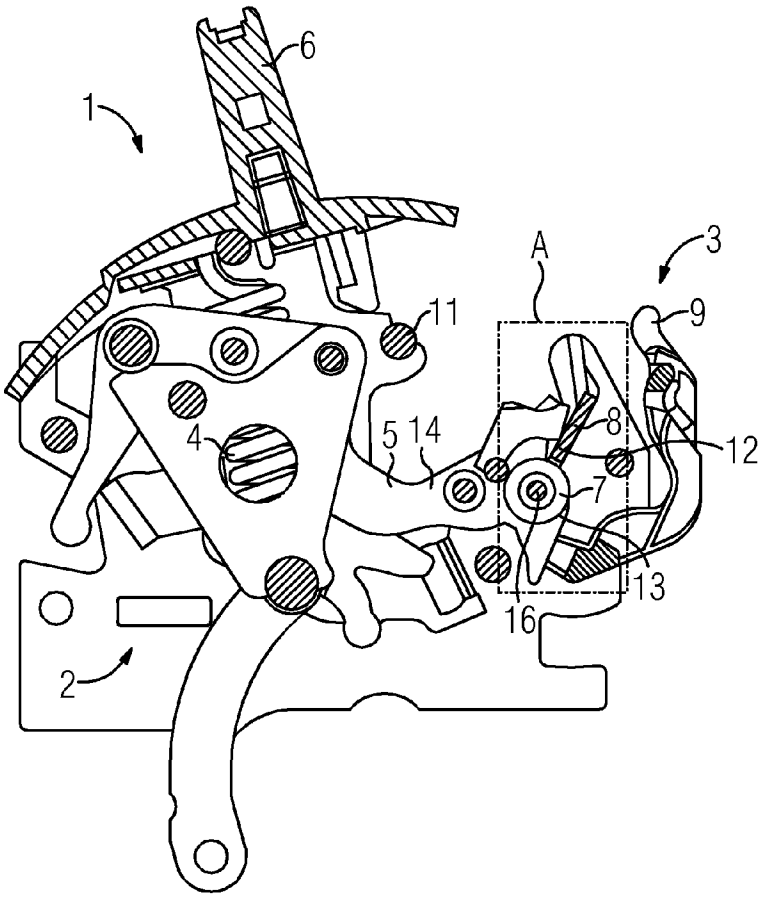
FIGS. 2 to 5 show four different views of the latch of a circuit breaker in the ON-position.
Figure 2:
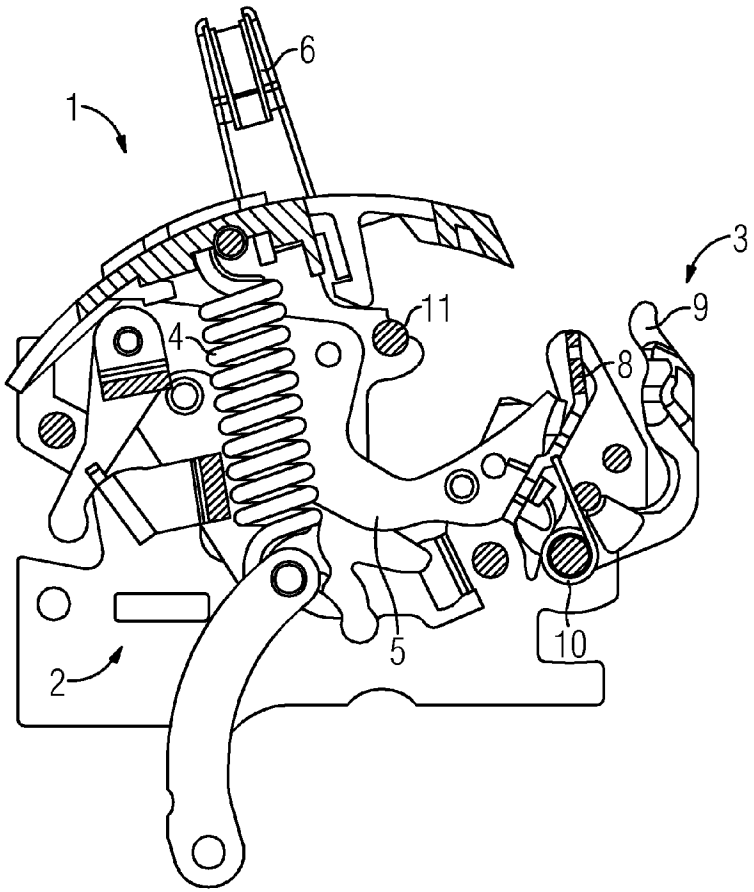
Figure 5:
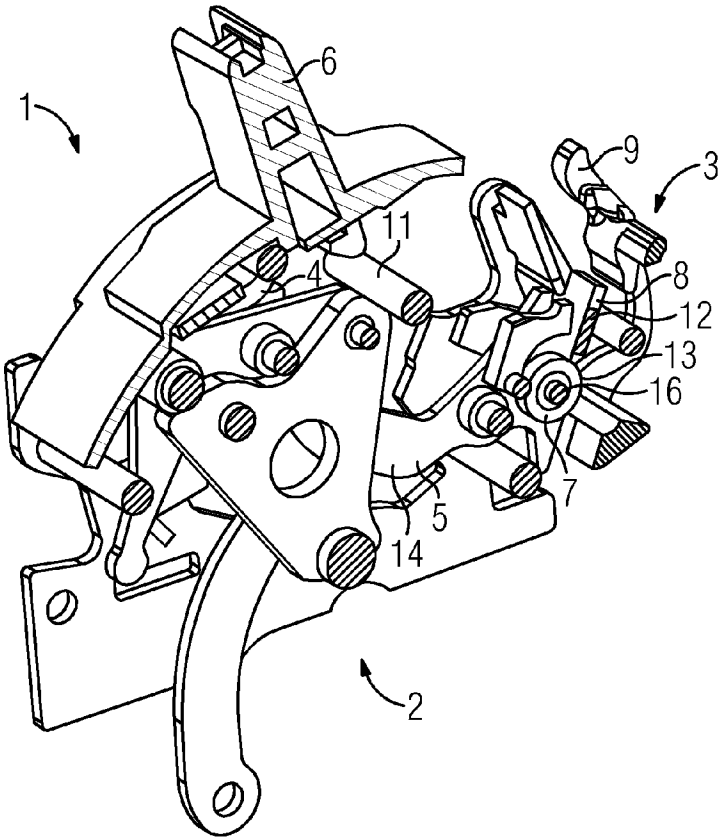
Figure 4:
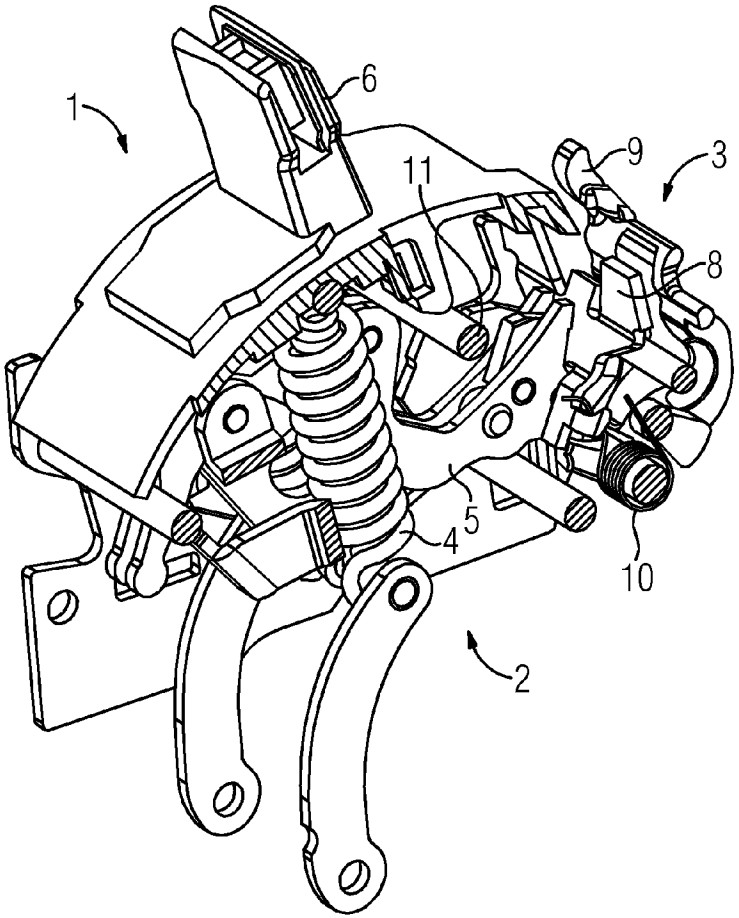

In FIGS. 2 to 5, the latch 1 whose components have already been explained in detail with reference to FIG. 1 is represented in an on-position. FIGS. 2 and 3 show a side view, FIGS. 4 and 5 a perspective view of the latch, wherein FIGS. 3 and 5 show the latch in a cutaway view in each case. In these cutaway views, the latch 1 is divided along the plane of symmetry and only the components provided in the rear section are shown in each case. Thus, the rear lateral section 14 of the tensioning lever 5, the roller 7 mounted thereon, and the end 12 of the locking pawl 8 are visible in FIGS. 3 and 5.

In the ON-position, the switch is closed, the spring 4 is charged and the latch 1 is in the locked state.

In addition, the unlatching mechanism 3, and therefore also the latch 1, is in the locked state, wherein the end 12 of the locking pawl 8 is in contact with the external circumference of a roller 7 rotatably mounted on the tensioning lever 5 in the region of the locating surface 13. The tensioning lever 5 is therefore locked in the position shown by way of the locking pawl 8, so that the spring 4 is charged and the electrical switching contact is closed.

Figure 6:
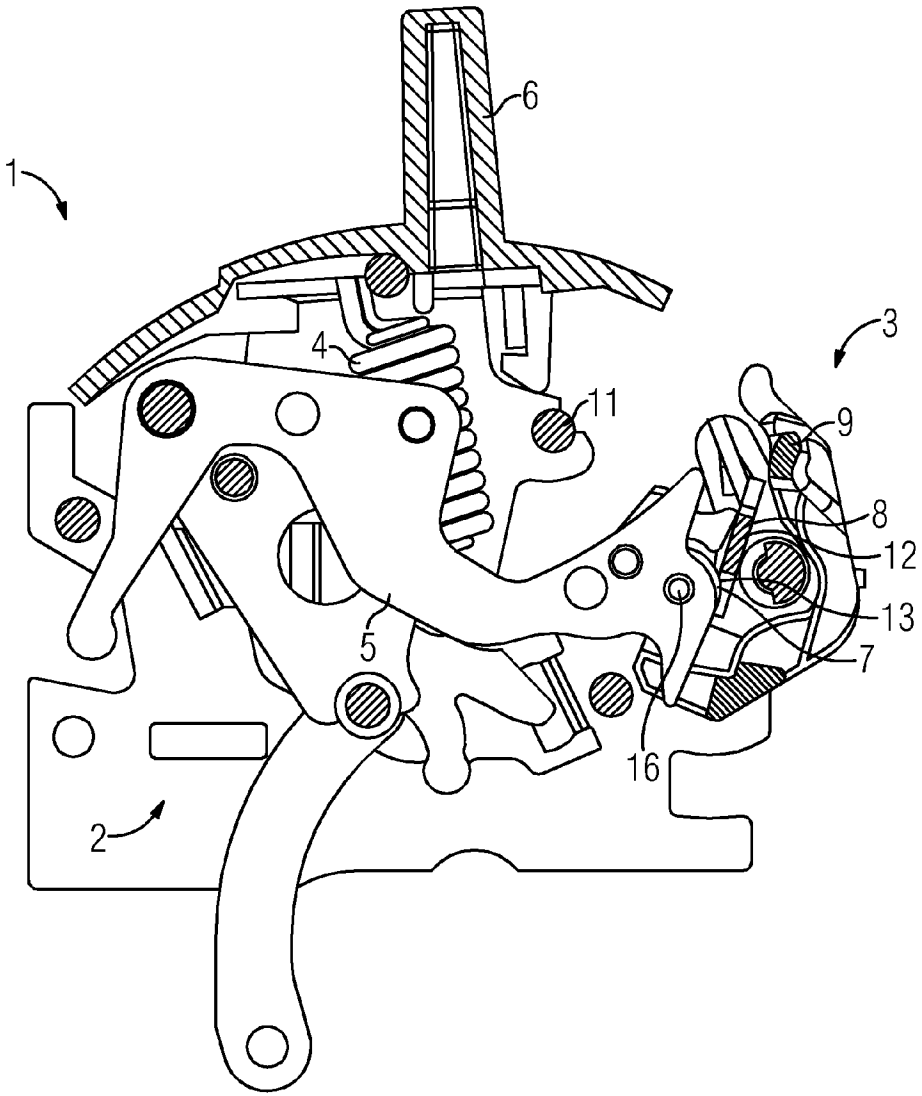
FIG. 6 shows a side view of the latch of a circuit breaker during the tripping process.

FIG. 6 shows a side view of the latch 1 in an operating state in which the latter is tripped. The tripping shaft 9 is actuated on the basis of a tripping signal so that the locking pawl 8 is moved counterclockwise away from the roller 7. The force with which the locking pawl 8 acts on the locating surface 13 of the roller 7 is then reduced, the locking pawl 8 loses contact with the roller 7 and finally slides off the roller 7. The releasing of the locking pawl 8 causes the tensioning lever 5 to finally likewise execute a rotational or rather pivoting movement counterclockwise, thereby causing the spring 4 to relax and opening the electrical switching contact.

Figure 8:
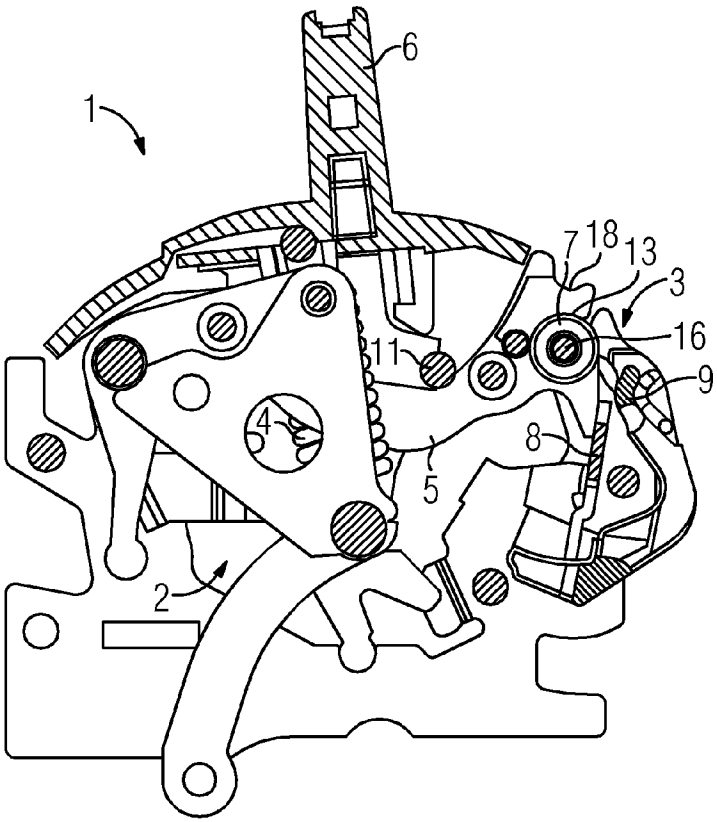
FIGS. 7 and 8 show a side view of the latch of a circuit breaker in the tripped state (trip position)
Figure 7:
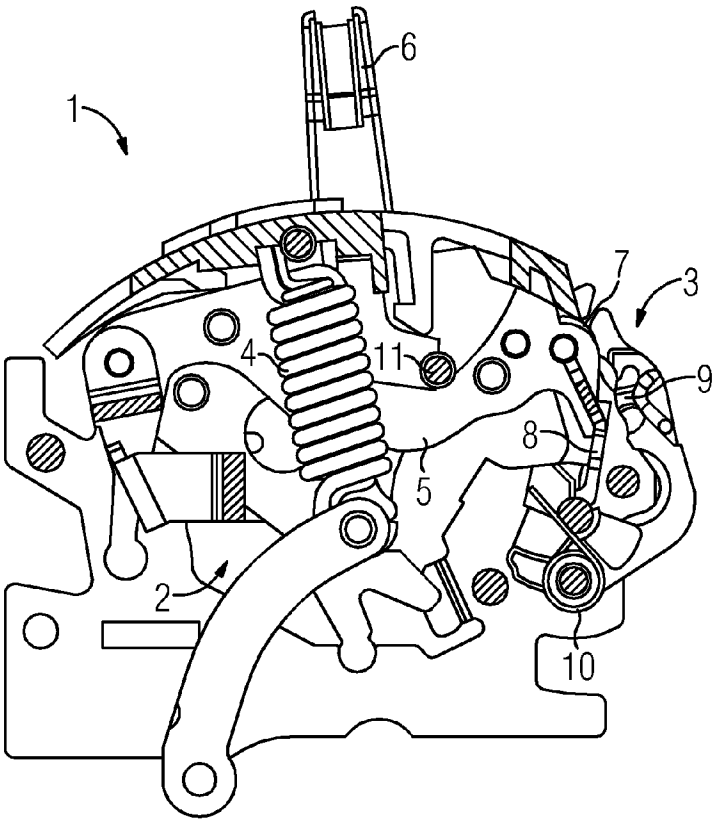

FIGS. 7 and 8 now show the latch 1 of a circuit breaker in the tripped position. This position of a latch 1 is also termed the trip position. The tensioning lever 5 with the roller 7 rotatably mounted thereon has been moved upward to its end position, resting against a tensioning bolt 11 mounted in the operating lever 6. If the latch 1 is to be returned from the trip position to the on-position, a reset must be carried out with respect to the latch 1, in particular to the unlatching mechanism 3, so that the unlatching mechanism 3 and here in particular the pawl spring 10 is tensioned and the tripping shaft 9 is returned to its starting position.

Figure 11:
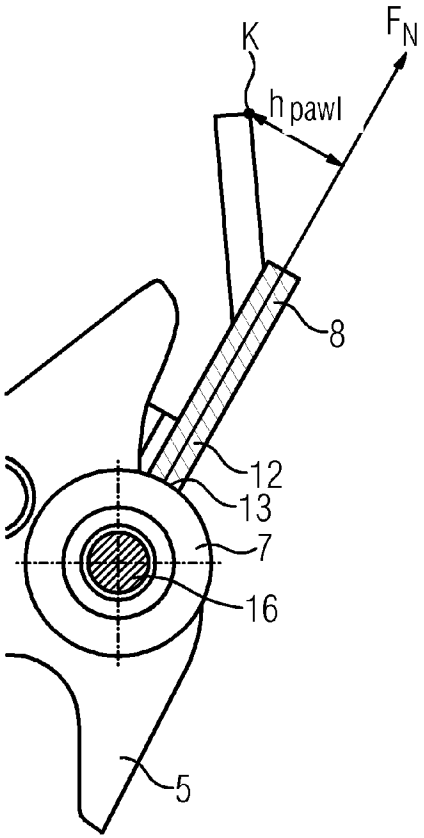
FIGS. 9 to 11 show detail views of a comparison of the latching mechanism known from the prior art with the inventively embodied latching.
Figure 10:
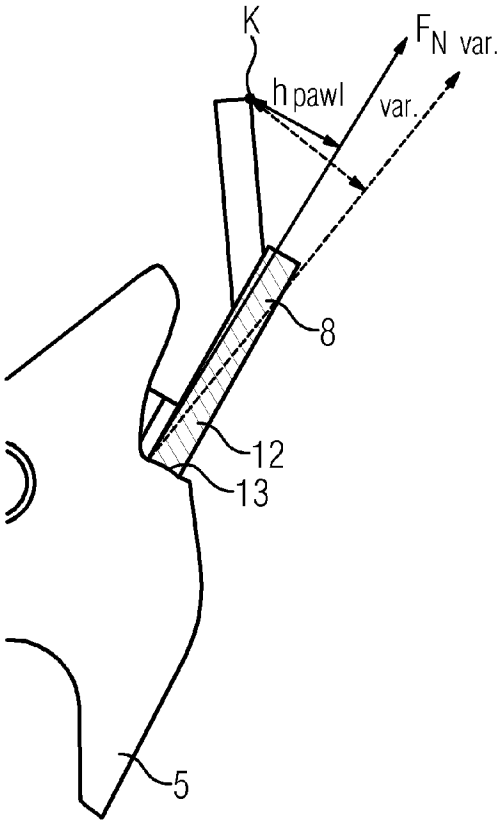
Figure 9:
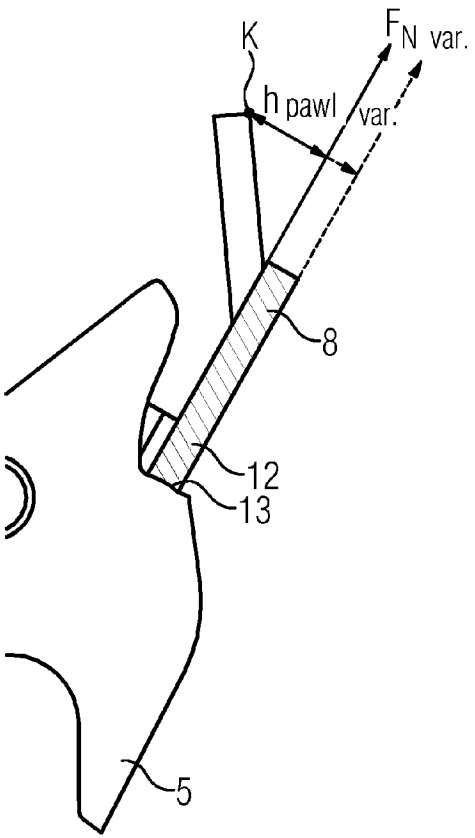

In FIGS. 9 to 11 a latching mechanism known from the prior art is compared with a design according to the invention. Firstly by way of illustration the side view already shown in FIG. 3 of the components disposed in the rear section of the latch 1 is again depicted. The invention is characterized in particular by an advantageous arrangement of the locating surface 13 provided on the tensioning lever side. FIGS. 9 to 11 show respective parts of the latch 1 in detail. Said FIGS. 9 to 11 show in each case the unlatching mechanism 3 end of the tensioning lever 5 with its locating surface 13 and the locking pawl 8 in contact therewith. FIGS. 9 and 10 show in this context the prior art way of supporting the locking pawl 8 on the locating surface 13 of the tensioning lever 5. In comparison thereto, FIG. 11 shows an inventively designed latching mechanism which is characterized by a movably disposed convex locating surface 13 which is implemented in this case by using the outer circumferential surface of a roller 7 rotatably mounted on the tensioning lever 5.

FIG. 9 shows a latching arrangement of the type known from the prior art in the new state. In this case a flat contact surface is provided between the end 12 of the locking pawl 8 and the locating surface 13. Also shown are the vector of the tripping force FNvar which runs in the normal direction, i.e. perpendicular to the locating surface 13, and the lever arm h between the normal vector and a point K about which the locking pawl 8 is rotated or rather pivoted.

In addition to this, FIG. 10 shows the known support after a certain service life. The essential point is that, because of the friction between the end 12 of the locking pawl 8 and the locating surface 13, a degree of wear has occurred on the locating surface 13 or rather the tensioning lever 5. Due to the abrasion, the contour of the tensioning lever 5 in the region of the locating surface 13 is somewhat leveled off compared to the initial state. As a result of the friction-induced leveling-off of the contour of the tensioning lever, the direction of the normal force FNvar changes, which in turn increases the tripping force of the latch 1 compared to the initial state.

The above described effect can so far only be reduced by employing harder materials, special surface treatment or more specifically by using lubricants. However, this would increase the costs while at the same time limiting the operating reliability and field of application. Another possibility for reducing abrasive wear is full-surface seating of the components. However, this technical solution has the disadvantage that the lever arm may vary the normal force and therefore the force required to trip the latch 1.

FIG. 11 now shows an inventive embodiment of the latching arrangement of a latch 1. In the locked state of the unlatching mechanism 3, the end 12 of the locking pawl 8 is in engagement with the outer circumferential surface of a roller 7 rotatably mounted on the tensioning lever 5. The main advantage of using a roller by which a movable, convex locating surface 13 is implemented is that the wear on the supporting components is significantly reduced. In addition, as a result of the support on the roller 7, the angle of the resulting normal force FN is kept approximately constant, so that the tripping force region is comparatively small and does not increase even with increasing service life of the components. As a result of the thereby caused minimization of the effect of friction, on the one hand the starting reliability of the locking pawl 8 is increased and, on the other, the leverage ratios in the unlatching mechanism 3 are adjusted such that the force reduction from switching mechanism 2 to tripping shaft 9 is very large and therefore only a comparatively small force is required to trip the latch 1.

Figure 12:
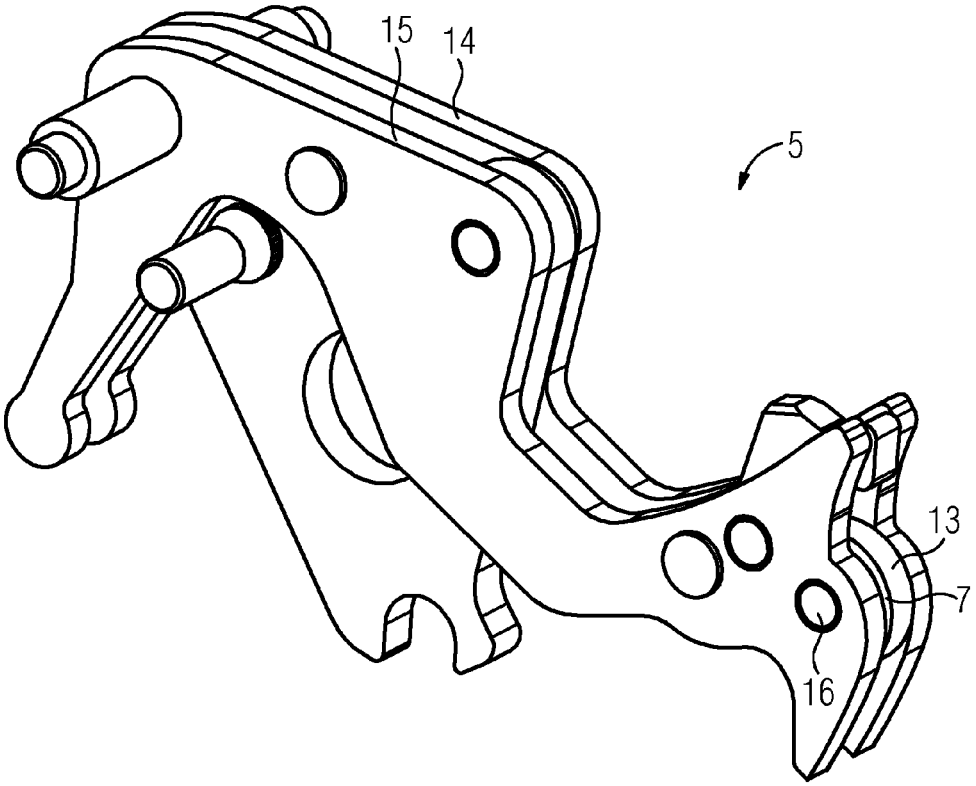
FIG. 12 shows a perspective view of the tensioning lever and associated roller.

FIG. 12 shows a perspective detail view of an inventively embodied tensioning lever 5 which provides a link between the spring element 4 of the switching mechanism 2 and the unlatching mechanism 3. Here the tensioning lever 5 is essentially in two parts and comprises two tensioning levers disposed in a plane parallel manner, in particular these are two identical components between which other components are disposed. In the region of the tensioning lever 5 which, in the installed position, faces the unlatching mechanism 3, a roller 7 is provided which is rotatably mounted in the tensioning lever 5 via two bearing studs 16.

Figure 13:
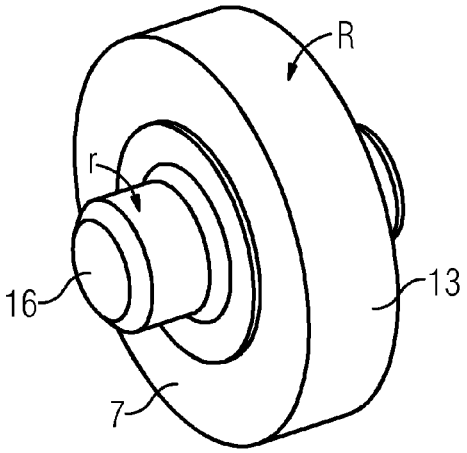
FIG. 13 shows a perspective view of a roller.

Finally, FIG. 13 shows the roller 7. The roller 7 embodied as a turned part has an external circumferential surface which is used as a locating surface 13 for the locking pawl 8. In terms of the design of the roller 7, it can be shown, put simply, that the effect of friction is reduced by the factor R/r, where R is the outside radius of the roller [and r] the roller bearing radius. In the case of a roller outside radius of R=5.4 cm and a roller bearing radius of r=1.7 cm, a factor of 3.18 is produced which corresponds to a more than threefold friction reduction.

Providing a roller 7 whose external circumferential surface constitutes the locating surface 13 for the locking pawl 8 of the unlatching mechanism 3 therefore enables in particular the starting reliability of the locking pawl and a minimization and restriction of the region of the tripping force to be achieved in a relatively simple manner.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A circuit breaker comprising:

a latch including a switching mechanism configured to open and close a switching contact operatively connected to a tensioning element; and an unlatching mechanism configured to, on the basis of a tripping signal, change the tensioning element from a tensioned state to an at least largely untensioned state, thereby opening the switching contact, the tensioning element being linked to a tensioning lever including a locating surface on which a locking pawl of the unlatching mechanism bears such that the locating surface holds the tensioning lever in place while the tensioning element is in the tensioned state with the force provided by the locking pawl on the locating surface, the locating surface being curved in a direction of the locking pawl and being movably disposed relative to the tensioning lever.

2. The circuit breaker of claim 1, wherein the locating surface is disposed on an outer circumferential surface of a roller.

3. The circuit breaker of claim 2, wherein the roller is embodied as a sheet metal part.

4. The circuit breaker of claim 1, wherein the locating surface comprises a plastic material.

5. The circuit breaker of claim 2, wherein the roller comprises a plastic material.

6. The circuit breaker of claim 1, wherein the tensioning lever includes two lateral sections between which a roller, on which the locating surface is disposed, is rotatably mounted.

7. The circuit breaker of claim 1, wherein the tensioning lever is of single-piece design and includes a recess inside which a roller with locating surface is provided.

8. The circuit breaker of claim 1, wherein the roller is mounted on the tensioning lever by way of a bearing stud or two bearing studs, and a quotient of roller radius and bearing pin radius is a value >1.0.

9. The circuit breaker of claim 2, wherein the locating surface comprises a plastic material.

10. The circuit breaker of claim 3, wherein the locating surface comprises a plastic material.

11. The circuit breaker of claim 3, wherein the roller comprises a plastic material.

12. The circuit breaker of claim 2, wherein the tensioning lever includes two lateral sections between which a roller, on which the locating surface is disposed, is rotatably mounted.

13. The circuit breaker of claim 2, wherein the tensioning lever is of single-piece design and includes a recess inside which a roller with locating surface is provided.

14. The circuit breaker of claim 2, wherein the roller is mounted on the tensioning lever by way of a bearing stud or two bearing studs, and a quotient of roller radius and bearing pin radius is a value >1.0.

* * * * *